US005231832A

United States Patent [19]

Tarman

[11] Patent Number: 5,231,832

[45] Date of Patent: Aug. 3, 1993

[54] HIGH EFFICIENCY EXPANSION TURBINES

[75] Inventor: Paul B. Tarman, Elmhurst, Ill.

[73] Assignee: Institute of Gas Technology, Chicago, Ill.

[21] Appl. No.: 914,758

[22] Filed: Jul. 15, 1992

[51] Int. Cl.[5] ..... F01K 9/02

[52] U.S. Cl. ..... 60/692; 60/649

[58] Field of Search ..... 60/643, 645, 649, 670, 60/692

[56] References Cited

U.S. PATENT DOCUMENTS

| | | |
|---|---|---|
| 1,666,523 | 4/1928 | Bailey . |
| 2,642,722 | 6/1963 | Vaughn . |
| 3,516,248 | 6/1970 | McEwen . |
| 3,603,087 | 9/1971 | Burkland . |
| 3,722,211 | 3/1973 | Conner et al. . |
| 3,834,166 | 9/1974 | Cupper et al. . |
| 3,841,099 | 10/1974 | Somekh . |
| 3,991,603 | 11/1976 | Wonn et al. . |
| 4,132,075 | 1/1979 | Fleck et al. . |
| 4,232,525 | 11/1980 | Enjo et al. . |
| 4,237,691 | 12/1980 | Bodmer . |

FOREIGN PATENT DOCUMENTS

| | | |
|---|---|---|
| 558194 | 12/1957 | Belgium . |
| 874451 | 4/1953 | Fed. Rep. of Germany . |
| 2112778 | 6/1972 | France . |
| 7613168 | 6/1977 | Netherlands . |
| 135452 | 11/1919 | United Kingdom . |

*Primary Examiner*—Stephen F. Husar

*Attorney, Agent, or Firm*—Speckman, Pauley & Fejer

[57] ABSTRACT

A process and apparatus for increasing the efficiency of expansion turbines of the type having working fluid vapor passing rotating blades within a casing and means for conducting the working fluid vapor into and out of the casing in which condensation nuclei are mixed with said working fluid vapor prior to passing said rotating blades, said condensation nuclei being supplied in sufficient numbers and size to form droplets of condensate of said vapor having an average diameter of below about 20 microns, thereby providing increased condensation of the working fluid vapor as compared with condensation without condensation nuclei.

23 Claims, 1 Drawing Sheet

HIGH EFFICIENCY EXPANSION TURBINES

BACKGROUND OF THE INVENTION

1. Field of the Invention

This invention relates to a method for increasing the operating efficiency of expansion turbines, providing more shaft power per pound of working fluid throughput. More particularly, this invention relates to a method for increasing turbine efficiency wherein increased condensation of the working fluid is accomplished without excessive vibration or turbine blade damage.

2. Description of the Prior Art

The use of power recovery turbines to harness the energy of waste heat streams has increased significantly as a result of escalating fuel costs. There have been many attempts to increase the reliability and efficiency of expansion turbines. Generally, the prior attempts have focused on corrosion control, turbine lubrication and improved Rankine cycle working fluids.

U.S. Pat. No. 3,991,603 teaches turbine damage due to induction of water into a turbine and a method to detect the presence and quality of moisture in the vapor flow of steam turbines. U.S. Pat. No. 4,237,691 teaches chemical corrosion control in steam turbines by the removal of water soluble impurities from the working fluid of a steam turbine. Belgium Patent 558,194 teaches chemical corrosion control by the introduction of ammonia derivatives into the working fluid and German Patent 874,451 teaches a corrosion reduction process which prevents salts from reaching the turbine blades. U.S. Pat. No. 1,666,523 teaches corrosion reduction by providing alkali nuclei around which moisture can form thereby diluting active corrosive materials introduced into the turbine to an extent that corrosion is reduced.

British Patent 135,452 teaches the injection of heavy mineral cylinder oil or equivalent grease into the steam service to reduce turbine blade corrosion. U.S. Pat. No. 2,642,722 teaches the use of any alkyl acid phosphate to temporarily emulsify the water present, thereby providing preferential wetting and lubrication by a refined low viscosity oil supplied in the steam service. U.S. Pat. No. 3,834,166 teaches the use of alkylated aromatic hydrocarbons as lubricants in expansion turbines. U.S. Pat. No. 3,603,087 teaches the use of dual Rankine cycle fluids wherein one fluid such as water is used as the working fluid and another fluid such as glycol is used as the lubricant.

U.S. Pat. No. 3,722,211 teaches a Rankine cycle working fluid of trifluoroethanol containing about 1 to 40 weight percent water. U.S. Pat. Nos. 3,841,099 and 4,232,525 teach the use of water-pyridine mixtures and tetrafluoropropanol-water mixture, respectively, as Rankine cycle working fluids. U.S. Pat. Nos. 3,516,248 and 4,132,075 teach use of a number of organic working fluids in a Rankine cycle system. French Patent Publication 2,112,778 and Dutch Patent Publication 7,613,168 teach the use of a silicon bromide-iodide mixture and an azeotropic mixture of methoxypropanol and water, respectively, as working fluids for turbines.

The aforementioned systems are not capable of increasing the efficiency of conventional power recovery turbine systems. Generally, the working fluid in power recovery turbines is a process stream such as high pressure steam. The prior art has recognized the disadvantages of water condensation in steam turbine working fluids and the resultant turbine blade damage and vibration resulting therefrom. In power recovery systems one does not have the flexibility to choose a more efficient direct working fluid, without a dual system involving heat exchange.

SUMMARY OF THE INVENTION

This invention provides a method for increasing the operating efficiency of expansion turbines. More particularly, this invention provides a method to increase turbine efficiency wherein additional latent heat is recovered by increased condensation of the working fluid. Excessive vibration and turbine blade damage is prevented by the formation of a large number of droplets small enough to avoid blade impact. Droplet size is controlled by supplying sufficient seed crystals or nuclei around which vapor condensation forms.

Condensation nuclei may be generated in the main feed stream flow or in a slip stream comprising a non-condensible carrier gas. This slip stream is added to the working fluid upstream of the turbine. Suitable nuclei, which may be produced by means known to the art such as spark discharge or heating and vaporizing salts, are present in the working fluid in sufficient quantity so that condensed droplet size within the turbine is maintained below about 20 microns, preferably below about 5 microns. Droplet size may be monitored by any conventional means, such as cascade impaction.

The efficiency improving method of this invention permits a larger fraction of the fluid throughput to be condensed within the turbine and, therefore, increases the efficiency of a conventional steam cycle from about 37 percent to above 40 and preferably above 50 percent. Furthermore, the method of this invention can be applied to any open or closed turbine system.

It is an object of this invention to provide a method for increasing the efficiency of expansion turbines.

It is another object of this invention to provide a method for increasing vapor condensation in expansion turbines without excessive vibration or turbine blade damage.

It is still another object of the invention to provide a method to control the condensation droplet size in expansion turbines.

BRIEF DESCRIPTIONS OF THE DRAWINGS

These and other objects, advantages and features of this invention will become apparent from the detailed description of preferred embodiments together with the drawings wherein:

FIG. 1 is a schematic diagram of a high efficiency turbine in accordance with one embodiment of this invention; and FIG. 2 is a schematic diagram of a high efficiency turbine in accordance with one embodiment of this invention.

DESCRIPTION OF PREFERRED EMBODIMENTS

In conventional Rankine cycle heat engines, such as steam turbines, condensation in the expansion turbine is limited to only a few percent of the working fluid throughput because of large droplet formation causing excessive vibration and turbine blade damage. The present invention provides a method for increasing turbine efficiency by allowing increased condensation of the working fluid while controlling condensate droplet size. By maintaining condensed droplets at an average diameter of below about 20 microns, significantly more working fluid vapor can be condensed, thereby providing greater latent heat for recovery while vibration and turbine blade damage is reduced if not eliminated. For example, the efficiency of a conventional steam cycle can be increased from the typical 37 percent to above 40, and preferably above 50 percent.

The process of this invention is particularly suited for steam power recovery. In the following detailed description the working fluid will be referred to as steam but it should be understood that the method of this invention is applicable to other working fluids, such as nitric acid, ammonia, propane, and butane. The process of this invention can be applied to any open or closed turbine cycle.

Figure 1:
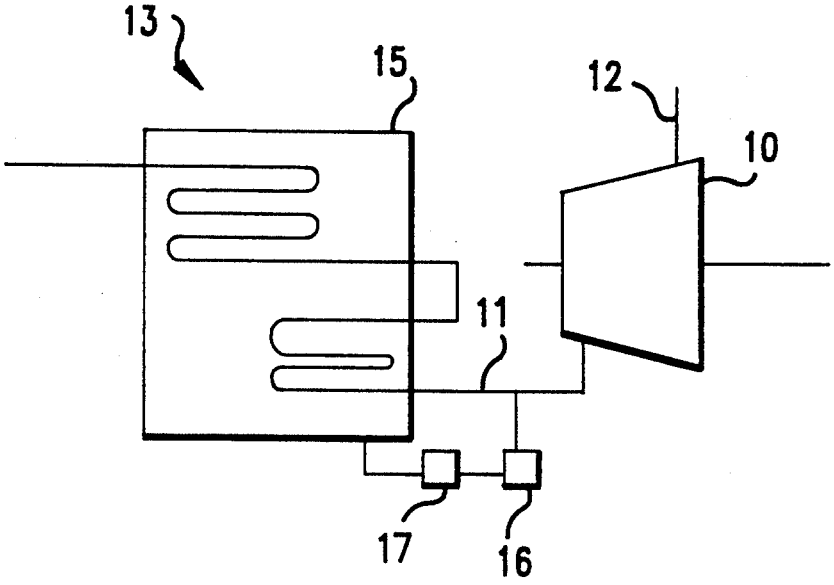

FIG. 1 shows a high efficiency turbine in accordance with one embodiment of this invention comprising expansion turbine 10 having inlet conduit means 11 through which condensation nuclei are introduced into expansion turbine 10. Condensation nuclei are generated by means for producing nuclei 13 in the form of salt vaporizer 15 or, in accordance with the embodiment shown in FIG. 2, arc or speak generator 18. To control the size of condensate droplets of working fluid vapor, measuring means 16 for measuring the size of the condensate droplets is operably linked to inlet conduit means 11 and provides a signal to electronic control means 17 for controlling the numbers and, thus, the size of the condensation nuclei produced by means for producing nuclei 13. In accordance with the embodiment shown in FIG. 2, the condensation nuclei are produced in a separate slip-stream conduit 14, which nuclei are then introduced into the working fluid vapor by flowing into inlet conduit means 11.

Figure 2:
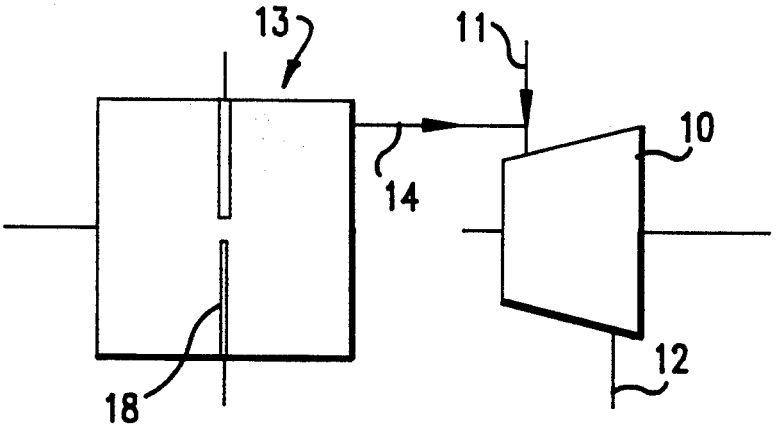

The process of this invention is suitable for any expansion turbine 10 as shown in FIGS. 1 and 2 of the type comprising a rotor shaft means carrying rotating blades within a casing and having inlet conduit means 11 directing working fluid vapor into the casing and over the blades and exhaust conduit means 12 removing expanded working fluid vapor from the casing. Such expansion turbines frequently have a casing which supports a number of annular arrays of stationary blades and extending centrally and axially through the casing is a rotor shaft having mounted thereon in alternating disposition with the stationary blades a number of annular arrays of rotating blades. The casing confines and guides a flow of high temperature, high pressure working fluid vapor over the stationary and rotating blades converting the high pressure and high temperature energy into rotational mechanical energy. The flow of high temperature, high pressure working fluid vapor for use in the expansion turbine according to this invention may originate from any suitable source, one preferred source being process exhaust streams such as high pressure steam. In such instances, the expansion turbine system is a power recovery system. The prior art has recognized that induction of water into turbines or the condensation of steam within the turbines has caused, in many instances, damage to the turbine blades necessitating costly downtime and repairs. The process and apparatus of this invention prevents turbine damage and vibration by control of the condensate size. The process and apparatus of the present invention comingles condensation nuclei with the working fluid vapor prior to its passing the rotating turbine blades. The condensation nuclei are supplied in sufficient number and size to form droplets of condensate of the vapor having an average diameter of below about 20 microns, and preferably below about 10 microns, thereby providing increased condensation of the working vapor as compared with condensation without condensation nuclei while avoiding contact of the droplets with the turbine blades. The increased condensation of the working fluid vapor directly increases the efficiency of the expansion turbine.

Condensation nuclei suitable for use in the process and apparatus of this invention may be produced by any suitable means for producing nuclei 13 within the suitable size range and range of condensation nuclei diameters. Suitable methods for producing such condensation nuclei include La Mer generators which produce particles of a suitable size and of a comparatively narrow range of sizes. Suitable condensation nuclei include ions produced by an arc or spark generator 18 creating a high voltage spark between impregnated electrodes for producing, for example, very fine particles of sodium chloride. Another means 15 of producing suitable condensation nuclei is by heating and vaporizing salts such as sulfuric acid, stearic acid, dioctyl phthalate, oleic acid, triphenyl and tricresyl phosphate, rosin, menthol, ammonium chloride, sulfur and the like are known for production of monodisperse aerosols.

The condensation nuclei may be introduced into or produced within the inlet conduit means 11 of the expansion turbine. One means for providing condensation nuclei is to produce the nuclei in a separate slip-stream conduit 14 and introduce the nuclei into the working fluid vapor by flow in a non-condensible carrier gas. The latter method is especially suitable in instances where multiple expansion turbines may be arranged in series and condensation nuclei introduced into the working fluid vapor inlet conduit for each expansion turbine.

The concentration of condensation nuclei in the working vapor is such that between about $10^9$ to about $10^{21}$, preferable about $10^{12}$–$10^{18}$, droplets per pound of condensed working vapor, preferably water, are produced. The condensation nuclei are supplied to the working fluid vapor prior to its passing over the rotating blades of the expansion turbine in sufficient number and size to form droplets of condensate of the working fluid vapor having an average diameter of below about 20 microns, preferably having an average diameter of below about 5 microns. The comingling of the condensation nuclei with the working fluid vapor prior to its passing the rotating turbine blades, provides increased condensation of the working fluid vapor, as compared with condensation without the condensation nuclei, and increases the efficiency of the expansion turbine without causing undesired vibration or undesired turbine blade damage. Increased condensation of greater than about 10 percent may be readily obtained with the method and apparatus of this invention and preferably increased condensation of greater than about 30 percent is obtained.

The size of the condensate droplets, of working fluid vapor may be readily measured by means 16 known in the art, such as by use of a cascade impactor to assure that the droplets have an average diameter of below about 20 microns. Upon ascertainment of the size of the condensate droplets, the number and size of the condensation nuclei may be adjusted so as to form the condensate droplets having an average diameter of below about 20 microns. It will be apparent to one skilled in the art upon reading this disclosure that electronic control means 17 are suitable, the size of the droplets of condensate being translated into an electronic signal which electronically control, for example, the heater producing condensation by heating and vaporizing salts so as to increase the number of condensation nuclei when the condensate droplets become undesirably large. Likewise, it is readily apparent that electronic controls may be used to adjust the size of the condensation nuclei by providing nuclei from different chemical salts, for example, to decrease the size of the condensation nuclei by production from a chemical salt producing smaller nuclei aerosols, in instances where the condensate droplets of the working fluid vapor become undesirably large.

I claim:

1. A method for increasing the efficiency of expansion turbines of the type having working fluid vapor passing rotating blades within a casing and conduit means for conducting the working fluid vapor into and out of said casing, said method comprising:

comingling condensation nuclei with said working fluid vapor prior to its passing said rotating blades, said condensation nuclei being supplied in sufficient number and size to form droplets of condensate of said vapor having a diameter whereby contact of said droplets with said rotating blades is avoided, thereby providing increased condensation of the working fluid vapor as compared with condensation without condensation nuclei.

2. The method of claim 1, wherein said droplets have an average diameter of below about 20 microns.

3. The method of claim 2, wherein said droplets have an average diameter of below about 5 microns.

4. The method of claim 1, wherein said condensation nuclei are produced in said conduit means for conducting the working fluid vapor into said casing.

5. The method of claim 1, wherein said condensation nuclei are produced in a slipstream and introduced into said working fluid vapor by flow in a carrier gas.

6. The method of claim 1, wherein said condensation nuclei are produced by spark discharge.

7. The method of claim 1, wherein said condensation nuclei are produced by heating and vaporizing salts.

8. The method of claim 1, wherein said condensation nuclei are present in said working vapor in a concentration whereby between about $10^9$ to about $10^{21}$ said droplets per pound of said condensate are produced.

9. The method of claim 8, wherein said concentration is such that between about $10^{12}$ to about $10^{18}$ said droplets per pound of said condensate are produced.

10. The method of claim 1, wherein said increased condensation is greater than about 10 percent.

11. The method of claim 1, wherein said increased condensation is greater than about 30 percent.

12. The method of claim 1 comprising the additional step of measuring the size of said droplets of condensate.

13. The method of claim 12 comprising the additional step of adjusting said number and size of said condensation nuclei so as to form said droplets of condensate having an average diameter of below about 20 microns.

14. The method of claim 1, wherein said working fluid vapor is selected from the group consisting of steam, nitric acid, ammonia, propane, butane and mixtures thereof.

15. The method of claim 14, wherein said working fluid vapor is steam.

16. The method of claim 15, wherein said condensation nuclei are present in a concentration whereby between about $10^{12}$ to about $10^{18}$ said droplets per pound of said condensate are produced and said increased condensation is greater than about 10 percent.

17. An expansion turbine comprising:

rotor shaft means carrying rotating blades within a casing;

inlet conduit means directing working fluid vapor into said casing and over said blades;

exhaust conduit means removing expanded working fluid vapor from said casing; and means for providing condensation nuclei to said working fluid vapor prior to its passing said rotating blades, said condensation nuclei being supplied in sufficient number and size to form droplets of condensate of said vapor whereby contact of said droplets with said rotating blades is avoided, thereby providing increased condensation of the working fluid vapor as compared without condensation nuclei.

18. The expansion turbine of claim 17, wherein said means for providing condensation nuclei produces said nuclei in said inlet conduit means.

19. The expansion turbine of claim 17, additionally comprising a slipstream conduit in communication with said inlet conduit means, said means for providing condensation nuclei produces said nuclei in said slipstream conduit means.

20. The expansion turbine of claim 17 comprising spark discharge means for producing said condensation nuclei.

21. The expansion turbine of claim 17 comprising salt heating and vaporizing means for producing said condensation nuclei.

22. The expansion turbine of claim 17 comprising measurement means for measuring the size of said droplets of condensate.

23. The expansion turbine of claim 22 comprising control means to provide the number and size of said condensation nuclei so as to form said droplets of condensate having an average diameter of below about 20 microns.

* * * * *